United States Patent [19]

Shivers

[11] Patent Number: 4,601,404

[45] Date of Patent: Jul. 22, 1986

[54] CONTAINER AND CLOSURE WITH TAMPER INDICATING MEANS

[76] Inventor: Horace L. Shivers, 21 Filmore St., Trenton, N.J. 08638

[21] Appl. No.: 725,917

[22] Filed: Apr. 22, 1985

[51] Int. Cl.[4] ..... B65D 55/02

[52] U.S. Cl. ..... 215/230; 215/365

[58] Field of Search ..... 215/230, 365, 366

[56] References Cited

U.S. PATENT DOCUMENTS

| | | | |
|---|---|---|---|
| 605,227 | 6/1898 | Henry . | |
| 881,945 | 3/1908 | Perez | 215/365 |
| 986,270 | 3/1911 | Daniels | 215/365 |
| 1,539,431 | 5/1925 | Schenkein . | |
| 2,025,498 | 12/1935 | Desmond . | |
| 2,066,889 | 1/1937 | Kay . | |
| 2,201,205 | 5/1940 | Samburg . | |
| 2,201,791 | 5/1940 | Samburg . | |
| 2,263,882 | 11/1941 | Lewis . | |

*Primary Examiner*—Donald F. Norton
*Attorney, Agent, or Firm*—William Lawrence Muckelroy

[57] ABSTRACT

This invention relates to an improvement in a container for liquids or solids which container is made of either plastic or glass or other transparent or translucent material and wherein there is a combination adapted to show any tampering with the container. The improvement being a closure made of a two piece cap wherein both pieces overlap and sandwich a portion of the tamper indicator therein-between. The invention provides a practical means for indicating any tampering with or opening of the container by an indelible mark of ink made by movement of a ball on the inside wall of a transparent tube connected to the container.

7 Claims, 5 Drawing Figures

CONTAINER AND CLOSURE WITH TAMPER INDICATING MEANS

BACKGROUND OF THE INVENTION

1. Field of the Invention

The invention is generally related to means for opening or closing a container and providing an indication when said container has been tampered with or opened. The invention is specifically related to an improved means for a closure for such a container wherein an indication of when the closed or sealed container has been tampered with is provided.

2. Description of the Prior Art

In 1925 Samuel Schenkein received U.S. Pat. No. 1,539,431 for a bottle closure which was an invention concerning a means for securing the closure of a bottle with a cap and to prevent unauthorized opening of the bottle. His invention uses a flexible member such as a cord or a wire through an opening in the cap with the other end of the member being provided with an enlargement such as a knot to prevent the member from being entirely drawn through the opening in the cap.

Lester L. Lewis in U.S. Pat. No. 2,263,882, issued in 1941, claimed an invention of a bottle with a closure that crushed a revenue stamp at the first opening of the bottle. The crushing is described as accomplished between a stopper and a member by means of an integral and unitary lifting rod. Similarly, Murray Kay in U.S. Pat. No. 2,066,889, issued in 1937, invented a non-refillable closure for containers wherein a valve element was incorporated into the closure means.

In 1940 Maurice Sanburg was issued U.S. Pat. Nos. 2,201,205 and 2,201,791 for a type of tamper proof closure for bottles designed to contain liquor or perfume. The Sanburg means for indicating tampering was an opaque band surrounding the neck of the bottle and a tamper indicating symbol on the container neck covered by said band such that when the band was removed the symbol on the container neck would become visible.

SUMMARY OF THE INVENTION

An improved combination of a closed bottle and a means for opening said container is provided with a means for providing an indication of whether means for opening said container has been either substituted or tampered with by a visible marking on the inside of a transparent or translucent cylindrical tube containing a ball of an absorbent material having indelible ink therein, the ball is attached to a cap for the container by means of a string, wherein the improvement is a cap comprised of two congruent pieces with one end of the string rigidly and permanently held inbetween the two pieces.

OBJECTS OF THE INVENTION

A primary purpose of this invention is to provide an improved safety bottle or container capable of easy manufacture wherein medicines, drugs and other articles to be consumed by the public and purchased over the counter may be bottled and wherein a positive indication of any tampering is provided.

These and other objects of the novel invention will become apparent to one of ordinary skill in the art from a reading of the foregoing description of the preferred embodiment in combination with the accompanying drawings wherein.

DESCRIPTION OF THE PREFERRED EMBODIMENT

Figure 1:
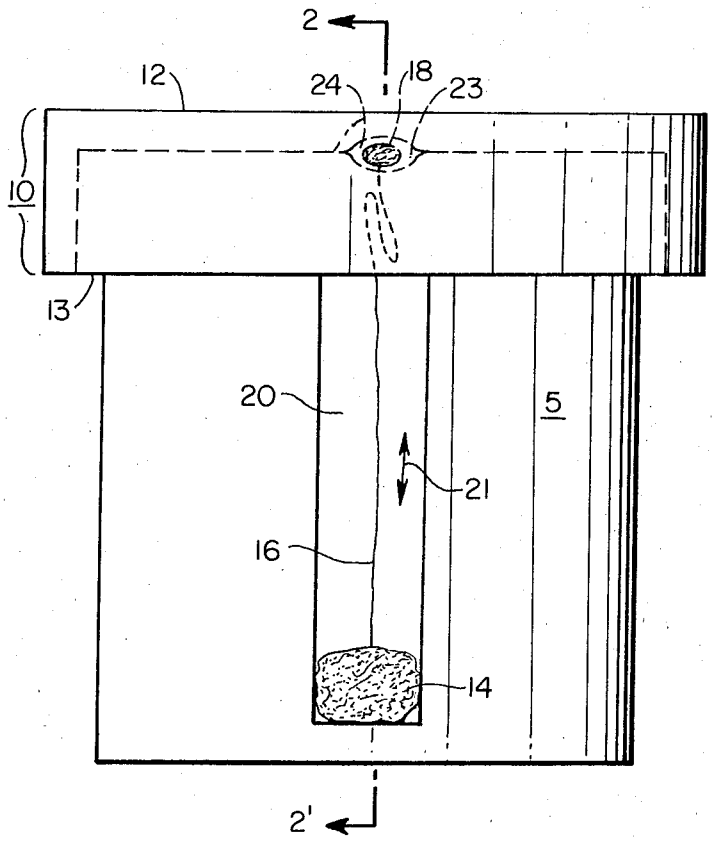
FIG. 1 is a front view of a container and closure incorporating the invention.

There is shown in FIG. 1 a container 5 covered and sealed by a closure 10, for example a two-piece cap. The closure 10 is made of an outer cap 12 and is press fitted over an inner cap 13. A ball 14 is connected to a string 16. The ball 14 is interconnected to a piece 18, for example, a molded plastic ball. The ball 14 is housed inside a tube 20 of glass, plastic or the like, for example. The tube 20 may be transparent or translucent, for example. The container 5 has a partially walled shaft 21. The tube 20 is adapted to fit inside the shaft 21.

The container 5 is made of glass, plastic or the like, for example. The closure 10 is a plastic cap, for example, which is adapted to screw onto the container 5. The container 5 may be specifically formed as a jar or a bottle or other container means.

The ball 14 is made of an absorbent material such as cotton, spun plastic or the like, for example, soaked with a non drying ink, preferrably red in color, for example. The string 16, of plastic, for example, has a first end attached to the ball 14 and a second end attached to the piece 18 made also of plastic, for example. The piece 18 has molded therein the second end of the string 16. The string 16 is of a length sufficient to extend as shown in FIG. 2 with virtually no slack.

In the preferred embodiment, the string 16 extends around the inner cap 13. Additional security may be obtained by a recessed notch (not shown) in cap 13. The notch may be adapted to receive the string 16. Alternatively, the space between the outer cap 12 and the container 5 may be further sealed by known means with a heat shrinkable plastic band.

The piece 18 is retained in a well 23 and restrained between the inner cap 13 and the outer cap 12 by a suitable means, such as adhesive 24, for example. The adhesive 24 may be of a material capable of permanently joining the cap 12, the piece 18 and the cap 13. The cap 12, the piece 18 and the cap 13 may also be made of a class of material or materials such that by the application of pressure to these parts via any suitable energy delivery process they are joined together. The cap 12, the piece 18 and the cap 13 are united to form an integral closure 10 as is shown in FIG. 1.

Figure 2:
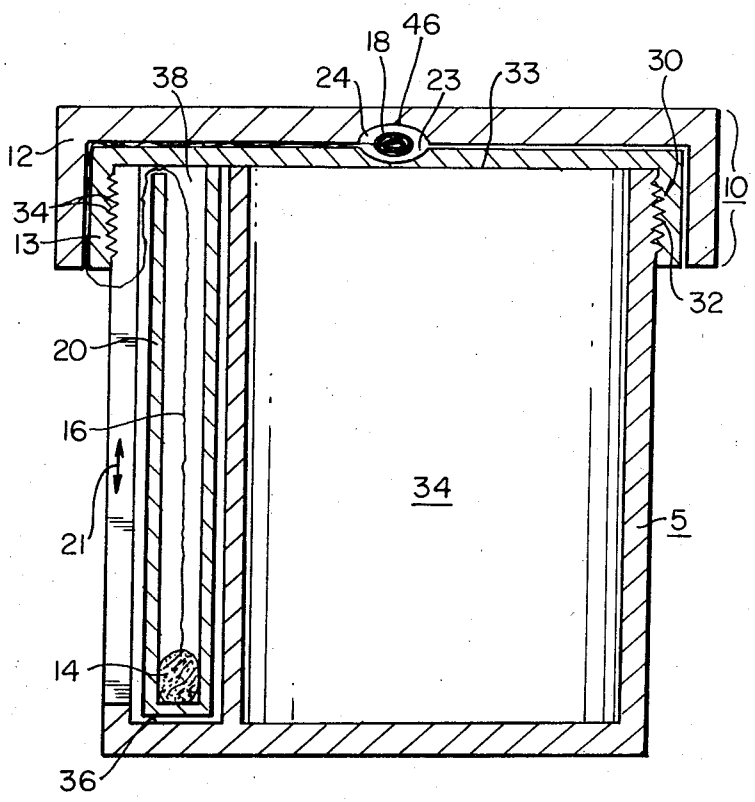
FIG. 2 is a cross sectional view of the container and closure taken at the plane 2—2' shown in FIG. 1.

Shown in FIG. 2 is a cross-section from the view of the plane 2—2' shown in FIG. 1. The cap 12 is shown in FIG. 2 surrounding the container 5. The cap 12 and the container 5 are illustrated with an exaggerated relative thickness. The container 5 has a lip 30 with threads 32 thereon. The cap 13 has threads 34 which form its inner vertical surface. The threads 32 secure the cap 13 to the container 5. The threads 34 mate with threads 32.

The lip 30 located at the mouth 32 of the container 5 is an example of an improved means for securing the closure 10 to the container 5. The two-piece closure 10 may be more easily manufactured and assembled and provides better security than a prior art cap assembly specified in a co-pending application filed Apr. 23, 1984 by H. Shivers, bearing Ser. No. 06/602,717 which issued as U.S. Pat. No. 4,545,493 on Oct. 8, 1985. The problem with the prior Shivers safety closure, resolved by this invention, is that the only practical way to attach an indicator means to the prior closure is after the safety closure has been placed on a container. Further, the improved closure 10 may be completely assembled without the application of any heat. The piece 18 may be permanently attached to the inner cap 13 with adhesive. The outer cap 12 may then be applied. The outer cap 12 also provides a shield to protect the piece 18 from tampering. In the earlier Shivers safety cap, the equivalent to piece 18 is exposed and subject to tampering.

The ball 14 is connected to the piece 18 by the string 16. The tube 20 is inside a cross section of the shaft 21 shown to be cylindrical in shape, for example. Similarly, the tube 20 is cylindrical in shape.

Figure 3:
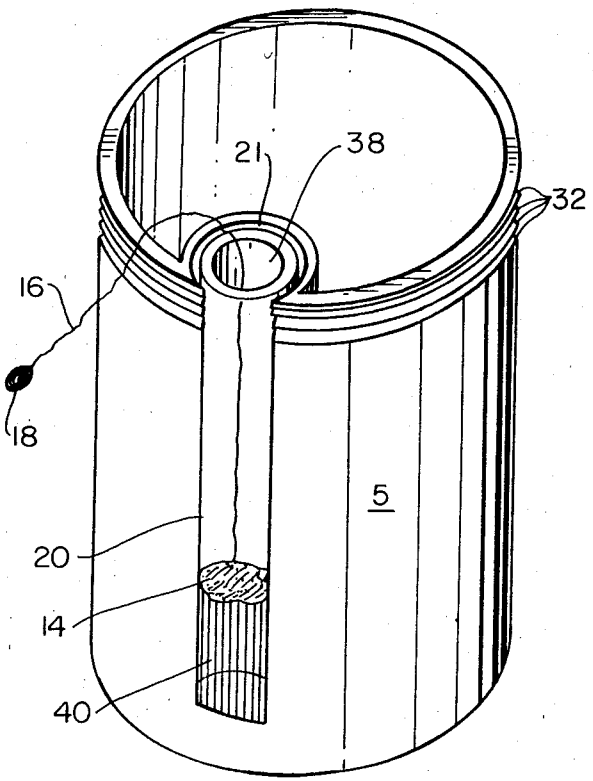
FIG. 3 is a perspective view of the container shown in FIGS. 1 and in FIG. 2.

The container 5 is shown in FIG. 3 in perspective view. The ball 14 is shown partially removed in relationship to the tube 20 with ink 40 partially on the inside of the tube 20. The closure 10 is not shown.

The inner cap 13 shown in FIG. 2 and the container 5, when together, form a plenum 34. A partially walled cylindrical shaft 21 with a bottom 36 is a part of the container 5.

In FIG. 3, there is shown the ball 14 connected by the string 16 to the piece 18. The ball 14 is inside the tube 20 which fits inside the shaft 21. The inner cap 13 is retained on the container 5 by a means for closing the container 5 such as the lip 30 with threads 32 thereon, for example. The closure 10 is retained on the container 5 by engagement of the threads 32 with the threads 34.

In FIG. 3, inside the tube 20 there is the ball 14 shown partially raised with the string 16 attached thereto. The tube 20 has an aperture 38 through which the string 16 exits for attachment to the closure 10 shown exploded in FIG. 4. Movement of the ball 14 up the tube 20 causes an indelible ink, preferrably red and soaked into the ball 14, to make a visible marking on the inside of the tube 20 which is visible to an outside observer (not shown) because of either transparency or translucency of the tube 20. Wrinkling of foil, another type of mechanical marking, is yet another indicator means provided by making the tube 20 out of a foil instead of glass or other transparent material. Movement of the ball 14 up the tube 20, when made of foil, causes visible wrinkling of the foil. A visible film 40, as shown in FIG. 3, coats the inside of the tube 20 up to the location of the ball 14.

Figure 4:
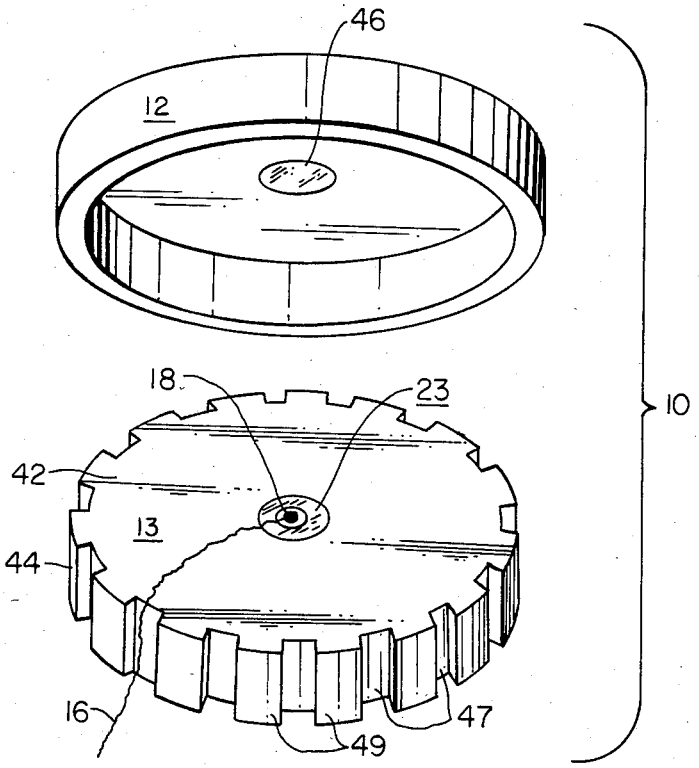
FIG. 4 is an exploded view of the improvement in the novel invention.

FIG. 4 is a detailed perspective view of outside surfaces 42 and 44 of the inner cap 13, the outer cap 12, the well 23, the string 16, grooves 47, ridges 49, and the piece 18. Also shown in an upper cavity 46 formed in the outer cap 12. The string 16 is restrained inside the closure 10. The ball 14 is attached to the closure 10 by an interconnecting means such as the string 16, for example.

As the closure 10 is removed from the container 5 shown in FIG. 2, the string 16 is in turn pulled up thereby raising the ball 14 which is soaked with indelible, non drying ink.

Figure 5:
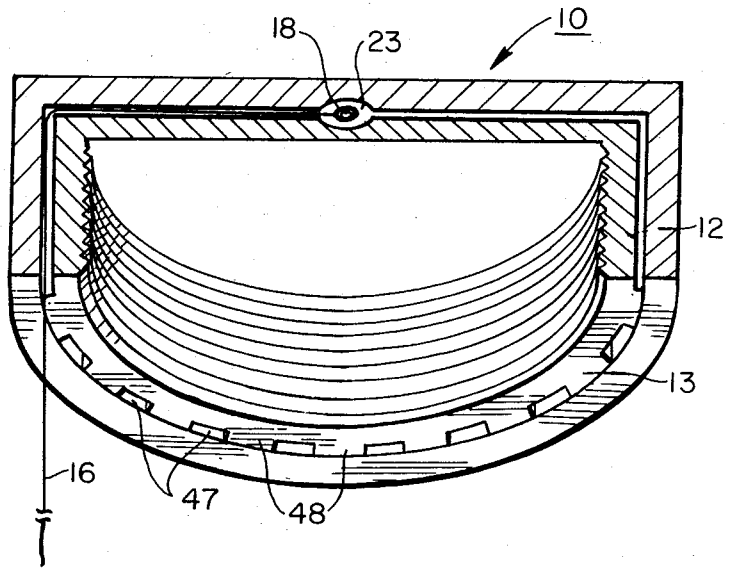
FIG. 5 is a perspective and cross section of the closure of the novel invention.

A cross section of the closure 10 is shown in perspective in FIG. 5. Inside the closure 10 are a series of grooves 47 and ridges 49 in between the inner cap 13 and the outer cap 12. The piece 18, made of molded plastic, for example, is attached to cap 12 and forms a part of the closure 10. The string 16 may be molded into the piece 18 and is shown dangling through one of the grooves 47 between the caps 12 and 13. The string 16 is attached to the ball 14 shown in FIG. 3.

Although the foregoing specification describes a specific detailed and preferred embodiment of the invention, it is to be understood that various modifications may be developed by persons of ordinary skill in the art and that although such equivalents are not specifically described herein, they are nevertheless encompassed by this invention as a comparable means or combination for providing an indelible or permanent indication of tampering. Accordingly, the invention is particularly claimed in the following enumerated claims.

What is claimed is:

1. An improved container and means for opening said container with tamper indicating means comprising:

a closed container;

means for opening said container attached thereto;

an elongated member having a first end and a second end;

a transparent enclosure having an interior wall, said enclosure being in contact with said container;

a piece forming a part of said first end of said member, said piece being connected to said means for opening said container;

means for visibly marking said enclosure located inside said enclosure and attached to said second end of said member, said means for visibly marking being disposed inside said enclosure whereby removal of said means for opening said container visibly marks at least a part of the interior wall of said enclosure;

said means for opening said container further comprising an inner cap having a well therein adapted to receive said piece and an outer cap adapted to be permanently connected to said inner cap; and, said inner cap and said outer cap being connected to said piece and to a portion of the elongated member whereby removal of said means for opening said container visibly marks at least a part of said enclosure.

2. The improved container and means for opening said container of claim 1 wherein said container has a cavity on the inside thereof adapted to receive and retain said transparent enclosure.

3. An improved container and means for opening said container with tamper indicating means comprising:

a closed container;

means for opening said container attached thereto;

a member having a first end and a second end;

an enclosure having a wall, said enclosure being in contact with said container;

a piece forming a part of said first end of said member, said piece being connected to said means for opening said container;

means for visibly marking said enclosure located inside said enclosure and attached to said second end of said member, said means for visibly marking being disposed inside said enclosure whereby removal of said means for opening said container visibly marks at least a part of the interior wall of said enclosure;

said means for opening said container further comprising an inner cap having a well therein adapted to receive said piece and an outer cap permanently connected to said inner cap; and, said inner cap and said outer cap being connected to said piece and to a portion of the member whereby removal of said means for opening said container visibly marks at least a part of said enclosure.

4. The improved container and means for opening said container of claim 3 wherein said container has a cavity on the inside thereof adapted to receive and retain said enclosure.

5. The improved container and means for opening said container of claim 4 wherein said container has a cavity on the inside thereof adapted to receive and retain said enclosure.

6. An improved container and means for opening said container with tamper indicating means comprising:

a container;

means for opening said container attached thereto;

a member having a first end and a second end;

a translucent enclosure having a wall, said enclosure being in contact with said container;

a piece forming a part of said first end of said member, said piece being connected to said means for opening said container;

means for visibly marking said enclosure located inside said enclosure and attached to said second end of said member, said means for visibly marking being disposed inside said enclosure whereby removal of said means for opening said container visibly marks at least a part of the interior wall of said enclosure;

said means for opening said container further comprising an inner cap having a well therein adapted to receive said piece and an outer cap permanently connected to said inner cap; and, said inner cap and said outer cap being connected to said piece and to a portion of the member whereby removal of said means for opening said container visibly marks at least a part of said enclosure.

7. The improved container and means for opening said container of claim 3 wherein said enclosure is comprised of foil.

* * * * *